US010941986B2

(12) United States Patent
Abart

(10) Patent No.: US 10,941,986 B2
(45) Date of Patent: Mar. 9, 2021

(54) CONTROL PLATE FOR COOLING CIRCUIT

(71) Applicant: INNIO Jenbacher GmbH & Co OG, Jenbach (AT)

(72) Inventor: Günther Abart, Jenbach (AT)

(73) Assignee: Innio Jenbacher GmbH & Co OG, Jenbach (AT)

( * ) Notice: Subject to any disclaimer, the term of this patent is extended or adjusted under 35 U.S.C. 154(b) by 101 days.

(21) Appl. No.: 16/289,778

(22) Filed: Mar. 1, 2019

(65) Prior Publication Data

US 2019/0271509 A1 Sep. 5, 2019

(30) Foreign Application Priority Data

Mar. 1, 2018 (EP) ..... 18159550

(51) Int. Cl.
*F28D 9/00* (2006.01)
*F28D 21/00* (2006.01)
(Continued)

(52) U.S. Cl.
CPC ..... *F28D 9/005* (2013.01); *F01P 11/04* (2013.01); *F01P 11/08* (2013.01); *F28D 9/0093* (2013.01);
(Continued)

(58) Field of Classification Search
CPC ..... F28D 9/005; F28D 9/0093; F28D 2021/0026; F28D 2021/0089;
(Continued)

(56) References Cited

U.S. PATENT DOCUMENTS 5,515,817 A 5/1996 Nurmi et al.
5,896,834 A 4/1999 Gruner
(Continued)

FOREIGN PATENT DOCUMENTS

DE 102012222946 A1 6/2014
DE 102015221528 A1 5/2017

OTHER PUBLICATIONS

European Search Report and Written Opinion dated Aug. 8, 2018 which was issued in connection with EP18159550.5 which was filed on Mar. 1, 2018.

*Primary Examiner* — Jacob M Amick
(74) *Attorney, Agent, or Firm* — Fletcher Yoder, P.C.

(57) ABSTRACT

Provided is a temperature management medium distributor for an internal combustion engine. The temperature management medium distributor comprises first connection openings for at least one engine temperature management circuit for temperature management of the internal combustion engine, at least one lubrication temperature management circuit for temperature management of a lubricant of the internal combustion engine, and at least one further medium circuit for removing from or supplying thermal energy to the internal combustion engine. The temperature management medium distributor also comprises second connection openings for heat exchangers. Using the heat exchangers, heat can be exchanged in a pairwise manner between each of the at least one engine temperature management circuit, the at least one lubrication temperature management circuit and the at least one further medium circuit. Also, channel sections are provided to produce fluid connections between the first connection openings and the second connection openings.

20 Claims, 5 Drawing Sheets

(51) Int. Cl.

| | |
|---|---|
| ***F01P 11/04*** | (2006.01) |
| ***F28F 9/26*** | (2006.01) |
| ***F01P 11/08*** | (2006.01) |
| ***F28F 9/02*** | (2006.01) |

(52) U.S. Cl.
CPC ..... *F28F 9/026* (2013.01); *F28F 9/26* (2013.01); *F01P 2060/04* (2013.01); *F28D 2021/0026* (2013.01); *F28D 2021/0089* (2013.01); *F28D 2021/0094* (2013.01); *F28F 2280/06* (2013.01)

(58) Field of Classification Search
CPC ... F28D 2021/0094; F01P 11/04; F01P 11/08; F01P 2060/04; F28F 9/026; F28F 9/26; F28F 2280/06
See application file for complete search history.

(56) References Cited

U.S. PATENT DOCUMENTS

| | | | | |
|---|---|---|---|---|
| 6,125,799 | A | 10/2000 | Van Son et al. | |
| 6,684,827 | B1 | 2/2004 | Sudmanns | |
| 2018/0252144 | A1* | 9/2018 | Shimatani ..... | F01P 7/16 |

* cited by examiner

CONTROL PLATE FOR COOLING CIRCUIT

FIELD OF TECHNOLOGY

The subject disclosure relates to a temperature management medium distributor for an internal combustion engine having the features of the classifying portion of claim 1 or 2, an internal combustion engine comprising such a temperature management medium distributor, a method for manufacturing an internal combustion engine having the features of the classifying portion of claim 16 and a usage of a temperature management medium distributor.

BACKGROUND

Internal combustion engines, which are known from the state of the art, typically comprise at least one engine temperature management circuit for temperature management of the internal combustion engine, wherein cylinders, in which a combustion takes place, can be almost entirely surrounded by a flow of temperature management medium (e.g. water), which discharges the high thermal loads produced during combustion from the affected components.

Furthermore, internal combustion engines as known from the state of the art widely comprise at least one lubrication temperature management circuit for temperature management of a lubricant (e.g. oil) of the internal combustion engine. Lubricants, which are used to lubricate movable parts of the internal combustion engine and which get heated by the movement and the combustion can be tempered by the at least one lubrication temperature management circuit. Also hydraulic fluid or a hydraulic medium of the internal combustion engine, which are used to move components of the internal combustion engine can be tempered by means of such a lubrication temperature management circuit.

Internal combustion engines, known from the state of the art also comprise at least one further medium circuit for removing thermal energy from the internal combustion engine. This thermal energy can after removing from the internal combustion engine be made use of further benefits.

It can be provided that the internal combustion engine is only tempered by one further medium circuit. In this case different heat management results are achieved based on different sequences and combinations of heat exchanges between the further median circuit, the at least one engine temperature management circuit and the at least one lubrication circuit (as opposed to two or more further medium circuits). These different orders of the flow through have different results. If the first tempered circuit (for example an engine temperature management circuit) is tempered to a low temperature level, the second temperature management circuit (for example a lubrication temperature management circuit) just can only be tempered to a higher temperature level compared to the first tempered circuit. Also the heating of the at least one further temperature management circuit differs if the order of the heat exchangers is changed.

In an operating condition of the internal combustion engine it could be desirable that the at least one further temperature management circuit is heated up as much as possible to a high temperature level and as a result to remove as much as possible thermal energy from the internal combustion engine. This high thermal energy can be used in a subsequent thermal process.

In view of this the order for temperature management between the at least one engine temperature management circuit, the at least one lubrication temperature management circuit and the at least one further temperature management circuit may vary depending on the requested overall efficiency of the internal combustion engine and depending on the area of application.

It can also be provided that at least two or more further temperature management circuits are provided, wherein each of the plurality of further temperature management circuits are connected with the at least one engine temperature management circuit or the at least one lubrication temperature management circuit.

For removing or exchanging the thermal energy from the at least one engine temperature management circuit and the at least one lubrication temperature management circuit by means of the at least one further temperature management circuit heat exchangers are provided, with which heat exchangers heat can be exchanged in a pairwise manner between each of the at least one engine temperature management circuit, the at least one lubrication temperature management circuit and the at least one further medium circuit. The removed thermal energy from the internal combustion engine can be led to other thermal systems (e.g. district heating plants) for using this thermal energy reasonable. This can also improve the overall efficiency of the internal combustion engine significantly.

It can also be provided that thermal energy is delivered by the at least one engine temperature management circuit or the at least one lubrication temperature management circuit. In that way the internal combustion engine can—for example—be heated before starting if the internal combustion engine is located in a cold environment.

For connecting the at least one engine temperature management circuit, the at least one lubrication temperature management circuit and the at least one further temperature management circuit to the engine block and the heat exchangers complex piping is required. This piping is mostly realized by metal pipes, which form the channel sections between the temperature management circuits and the heat exchangers. This causes high costs because much time is needed to install the piping. Another negative factor of this complex piping is that lots of space is needed to connect the circuits, the internal combustion engine and the heat exchangers, especially since the reduction of the space requirements of the assembly becomes more and more important.

Manufacturing an internal combustion engine with at least one further medium circuit is especially high in effort, because there are many different combinations for connecting the heat exchangers, depending on the areas of application.

SUMMARY OF THE DISCLOSURE

The object of the subject disclosure is to provide a temperature management medium distributor for an internal combustion engine, which provides an easy way and/or a possibility on a reduced assembly space to connect heat exchangers in different ways with the internal combustion engine.

This object is accomplished by a temperature management medium distributor for an internal combustion engine having the features of claim 1 or 2, an internal combustion engine comprising such a temperature management medium distributor according to claim 14, a method for manufacturing an internal combustion engine having the features of claim 16 and a usage of a temperature management medium distributor according to claim 17.

According to a first variant of the disclosure there is provided a first group of the channel sections for the at least one further medium circuit, which, if the heat exchangers are connected, leads a flow of the at least one further medium circuit at first to a heat exchange with the at least one engine temperature management circuit and then to a heat exchange with the at least one lubrication temperature management circuit, and there is provided a second group of the channel sections for the at least one further medium circuit, which, if the heat exchangers are connected, leads the flow of the at least one further medium circuit at first to a heat exchange with the at least one lubrication temperature management circuit and then to a heat exchange with the at least one engine temperature management circuit.

If there are at least two further medium circuits according to a second variant of the disclosure, wherein there can be provided a first group of the channel sections for at least one of the at least two further medium circuits, which, if the heat exchangers are connected, leads a flow of at least one of the at least two further medium circuits at first to a heat exchange with the at least one engine temperature management circuit and then to a heat exchange with the at least one lubrication temperature management circuit, that there can be provided a second group of the channel sections for at least one of the at least two further medium circuits, which, if the heat exchangers are connected, leads the flow of at least one of the at least two further medium circuits at first to a heat exchange with the at least one lubrication temperature management circuit and then to a heat exchange with the at least one engine temperature management circuit, and that there is provided a third and fourth group of the channel sections for at least one first and at least one second of the at least two further medium circuits, which, if the heat exchangers are connected, leads the flows of the at least one first and at least one second of the at least two further medium circuits by the third and fourth group of the channel sections in parallel to the heat exchanges with the at least one engine temperature management circuit and the at least one lubrication temperature management circuit.

In short: It can be achieved by the disclosure, that the at least one further circuit can be integrated into the heat management concept of the internal combustion engine in any desired way by essentially making it possible to realize each possible interconnection option.

Both the method for manufacturing an internal combustion engine and the internal combustion engine itself become less complex, which at the same time allows to design the temperature management distributor more compact.

In an embodiment of the disclosure it can be provided, that the first and the second group of channel sections have common channel sections.

In an embodiment of the disclosure it can be provided, that at least two of the first, the second, the third and the fourth group of channel sections have common channel sections.

Channel sections, which are common for the groups (first group, second group, third group and/or fourth group) are flowed through according to the desired interconnecting situation. If—for example—the first group is realized in a concrete temperature management medium distributor according to the disclosure, channel sections, which are common to the first group of channel sections and other groups, are flowed through according to the first group of channel sections. Other groups, having the same channel sections, can obviously not be realized at the same time (but could be after a reconfiguration of the temperature management medium distributor).

If a plurality of groups comprises the same channel sections the possibility is created to design the temperature management distributor much more compactly. For example, channel sections can comprise a plurality of connection openings, wherein the flow through and/or the flow direction can be chosen by closing or connecting these connection openings. Channel sections, which are not used in a certain group can of course be used in a different group.

It can be provided, that the temperature management medium distributor is formed in one piece or formed out of a set of components. It is formed in a one pieced cast part or is formed out of a set of cast parts. Accordingly, the channel sections may be cumulated into one component or more components. This allows a cost-efficient manufacturing of one or more components, which can be used for different model types and/or different areas of application. The reproducibility can be increased and the costs for manufacturing can be reduced. Furthermore, the—potentially casted—temperature management medium distributor is more robust against external influences.

It is provided, that the channel sections are configured as cavities (instead of pipes). Consequently, it is possible to design the channel sections not only by circular cross-sections. Also cross-sections narrowing or cross-section widenings can be provided for to reduce or accelerate the flow rate according to the desired application.

For an embodiment it can be provided, that the temperature management medium distributor comprises a first manifold and a second manifold comprising each a plurality of channel sections, wherein the channel sections of the first manifold and the channel sections of the second manifold can be connected to form a fluid connection through an interface. It can be provided, that a baffle plate—made of sheet metal—can be inserted at the interface, by which baffle plate at least one of the fluid connections between the channel sections of the first manifold and the second manifold can be blocked or at least partially be connected.

In such an embodiment of the disclosure it can further be provided that a cast plate is cast in such a way as to include a plurality of channel sections, and wherein these channel sections in the cast plate comprise interfaces, which can be blocked by inserting baffle plates.

In a further embodiment it can be provided, that the flow through the channel sections can be defined by plugs attached to individual connection openings and/or attached at channel sections between individual connection openings. Using a cast plate—for example—comprising a plurality of channel sections each channel section can comprise more than one opening, wherein the channel sections can be used in any desired configuration by connecting these connection openings or by closing them. Using such panels, plugs and/or connecting pipes the groups (first group, second group, third group and/or fourth group) can be built. In particular channel sections can be used for more than one group.

It is provided, that that the temperature management medium distributor is designed by at least two separate parts. Particularly are embodiments where the at least two separate parts have at least one flange side, which comprises flange openings to the channel sections, wherein the at least two separate parts can be connected with each other at the at least one flange side. In a further embodiment it is provided, that the channel sections at least partially merge into one another at the flange side. Alternatively or additionally it can be provided, that a baffle plate is provided between the at least two separate parts—between the flange sides of the at least two separate parts—by which one or more flange openings of the channel sections can be blocked or at least partially be connected.

Protection is also sought for an internal combustion engine—stationary reciprocating piston engine—comprising a temperature management medium distributor, wherein the first connection openings are connected with at least one engine temperature management circuit, with at least one lubrication temperature management circuit and with at least one further medium circuit and wherein the second connection openings are connected to heat exchangers. The at least one lubrication temperature management circuit, the at least one engine temperature management circuit, and the at least one further medium circuit can by means of the temperature management medium distributer be connected to the heat exchangers in such a manner that the flows through the heat exchangers point in opposite directions. Such a counter-flow in the heat exchangers gives an optimal heat exchange between the circuits.

Furthermore, protection is sought for a method for manufacturing an internal combustion engine, wherein for essentially all internal combustion engines of a model line temperature management medium distributors with essentially the same design, but depending on the desired order and/or the desired combination of the heat exchange in a pairwise manner between the at least one further medium circuit on the one hand and the at least one engine temperature management circuit and the at least one lubrication temperature management circuit on the other hand, are used in different configurations.

In a method for manufacturing an internal combustion engine with a temperature management medium distributor with essentially the same design it can be provided, that these temperature management medium distributors are placed in the same location within the arrangement of the internal combustion engine, where the at least one engine temperature management circuit and the at least one lubrication temperature management circuit have fixed connection openings at the temperature management medium distributor and wherein the heat exchangers also have fixed connection openings at the temperature management medium distributer. In short: the at least one engine temperature management circuit, the at least one lubrication temperature management circuit and the heat exchangers are always connected in the same way to the temperature management medium distributor, independently of the model type or the size of the internal combustion engine. The different combinations or sequences for temperature management by means of the at least one temperature management medium circuit are realized by varying the connection openings for the at least one temperature management medium circuit, by arranging plugs at the connection openings or the flange openings and/or by connecting connection openings with the help of connecting pipes or other connecting pieces.

Also protection is sought for the usage of a temperature management medium distributor according to the disclosure for a method for manufacturing an internal combustion engine according to the disclosure.

BRIEF DESCRIPTION OF THE DRAWINGS

Further advantages and details of the disclosure will be apparent from the figures and the related specific description. In the drawings.

DETAILED DESCRIPTION

Figure 1:
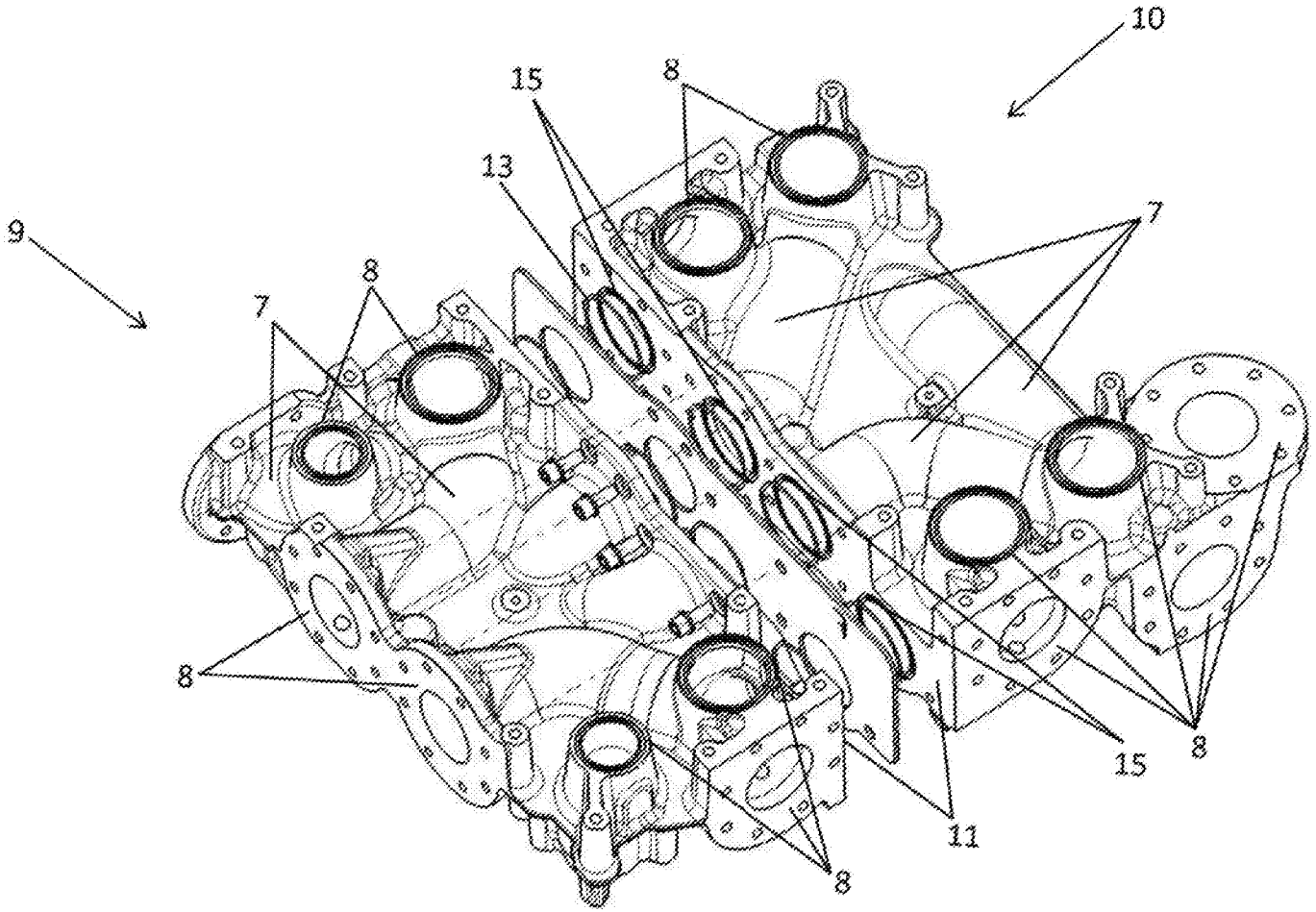
FIG. 1 shows an embodiment of a temperature management medium distributor for an internal combustion engine.

FIG. 1 shows an embodiment of a temperature management medium distributor 1 for an internal combustion engine 2 in an exploded view according to the disclosure. The temperature management medium distributor 1 is designed by two separate parts 9, 10 forming separate manifolds, in this case two casted parts. These separate parts 9, 10 do have a plurality of connection openings 8, wherein in each case between a first connection opening 8 and a section connection opening 8 channel sections 7 are provided. The connection openings 8 are provided to connect the at least one engine temperature management circuit 3 for temperature management of the internal combustion engine 2, the at least one lubrication temperature management circuit 4 for temperature management of a lubricant of the internal combustion engine 2 and the at least one further medium circuit 5 for removing from or supplying thermal energy to the internal combustion engine 2 with the heat exchangers by means of the channel sections 7.

The two separate parts 9, 10 can be connected together with their flange sides 11. Therefore, on each flange side 11 of the two separate parts 9, 10 flange openings 15 of the channel sections 7 are provided, leading to the channel sections 7. Between the two separate parts 9, 10 a baffle plate 12 is provided by which one or more flange openings 15 of the channel sections 7 can be blocked or at least partially be connected. For a better sealing between the two separate parts 9, 10 and the baffle plate 12—which is arranged between the two separate parts 9, 10—O-rings 13 are provided surrounding the flange openings 15 of the channel sections 7.

Channel section 7 may not only extend between two connection openings 8, but can at least partially have more than two sections and can also connect more than only two connection openings 8. Therefore a combination or sequence of the flow through the channel sections 7 can be chosen freely by blocking channel sections 7 with plugs 14 or blocking channel sections 7 with baffle plates 12 or by connecting of two connection openings 8 by means of a connecting piece.

Figure 2:
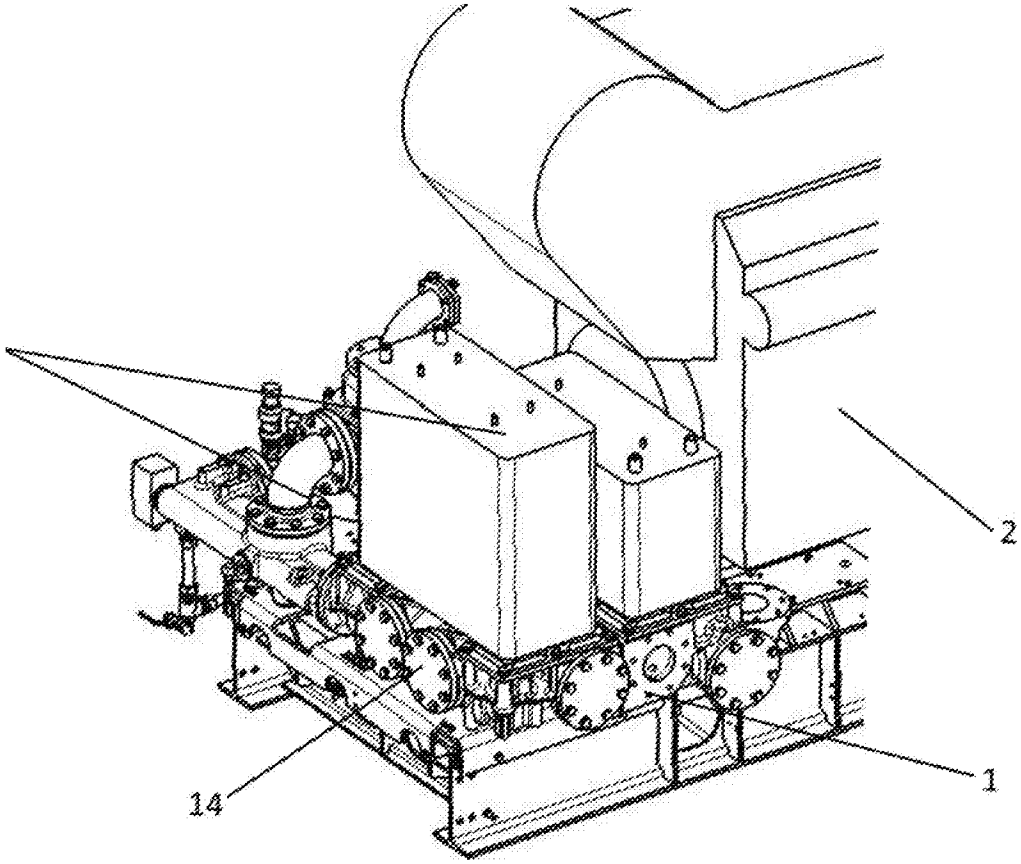
FIG. 2 shows an embodiment of a temperature management medium distributor for an internal combustion engine in a mounted situation.

FIG. 2 shows an embodiment of a temperature management medium distributor 1 according to the disclosure for an internal combustion engine 2 in a mounted situation. In this embodiment heat exchangers 6 are mounted directly at the temperature management medium distributor 1. The temperature management medium distributor 1 is connected to the internal combustion engine 2 using conducts (not shown in this figure for reasons of clarity), by which the at least one engine temperature management circuit 3, the at least one lubrication temperature management circuit 4 and the at least one further medium circuit 5 are lead to the temperature management medium distributor 1. It can be seen by this figure that individual connection openings 8 are blocked by plugs 14. Furthermore, it can be seen from the embodiment of FIG. 2 that for an arrangement with an internal combustion engine 2 very little space is required for a temperature management medium distributor 1 according to the disclosure and a simple and space-saving piping is possible.

Figure 3A:
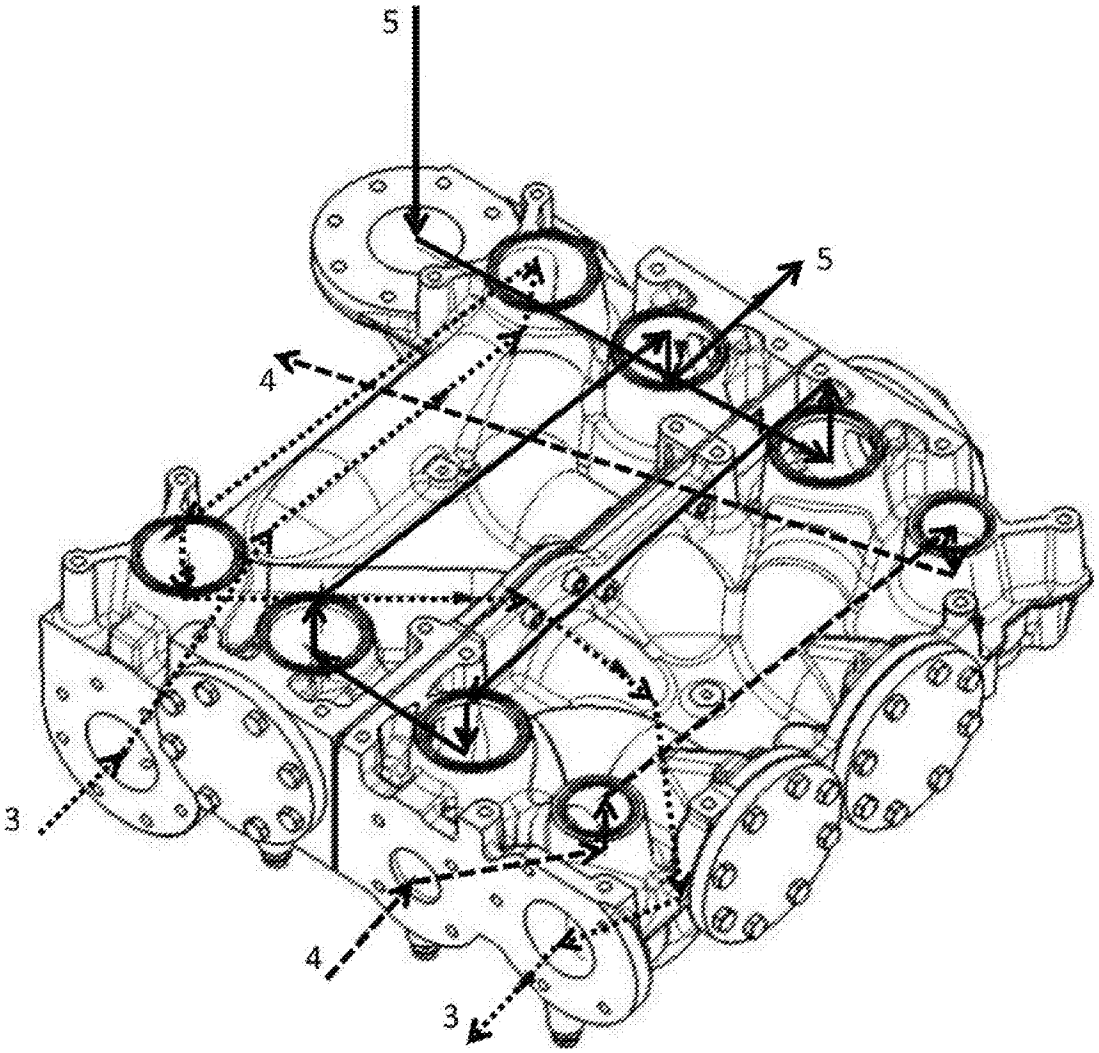
FIGS. 3A, 3B and 3C show different application variants of the temperature management medium distributor.
Figure 3B:
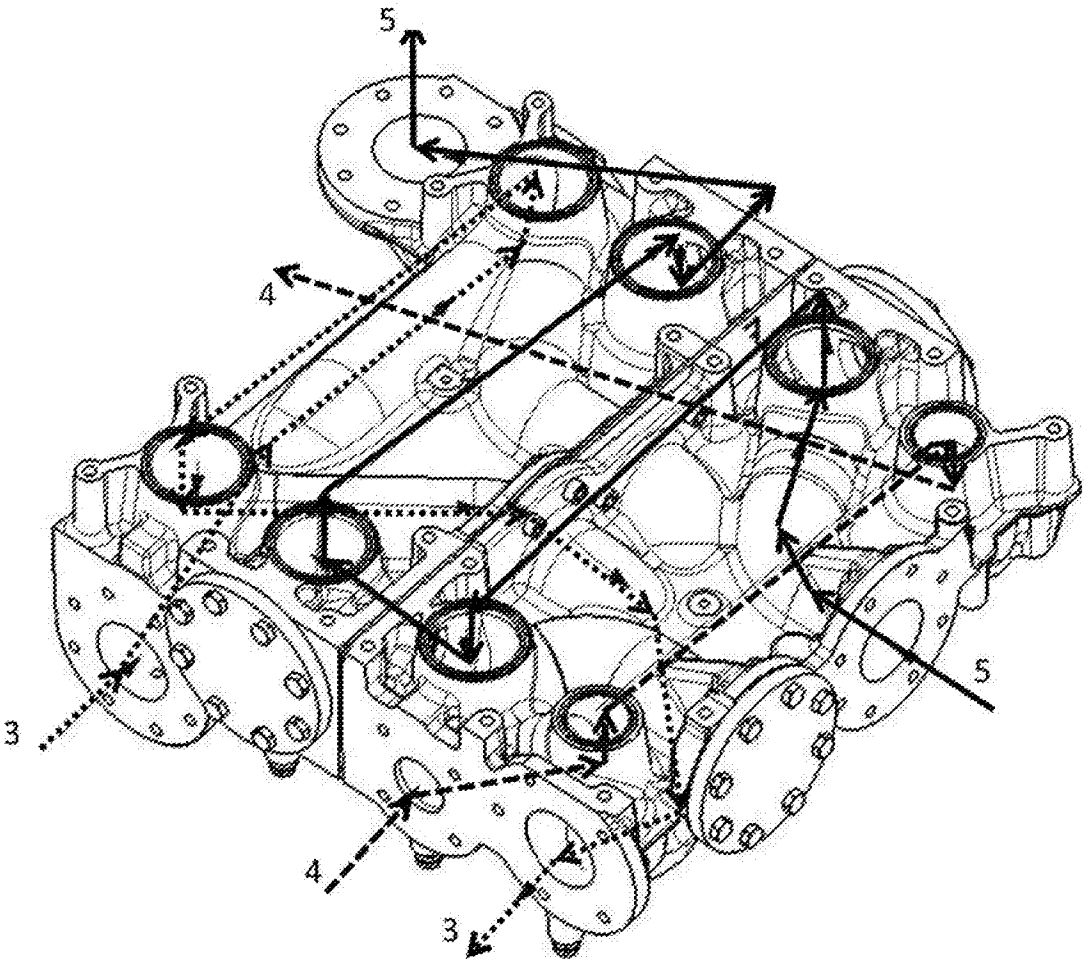
Figure 3C:
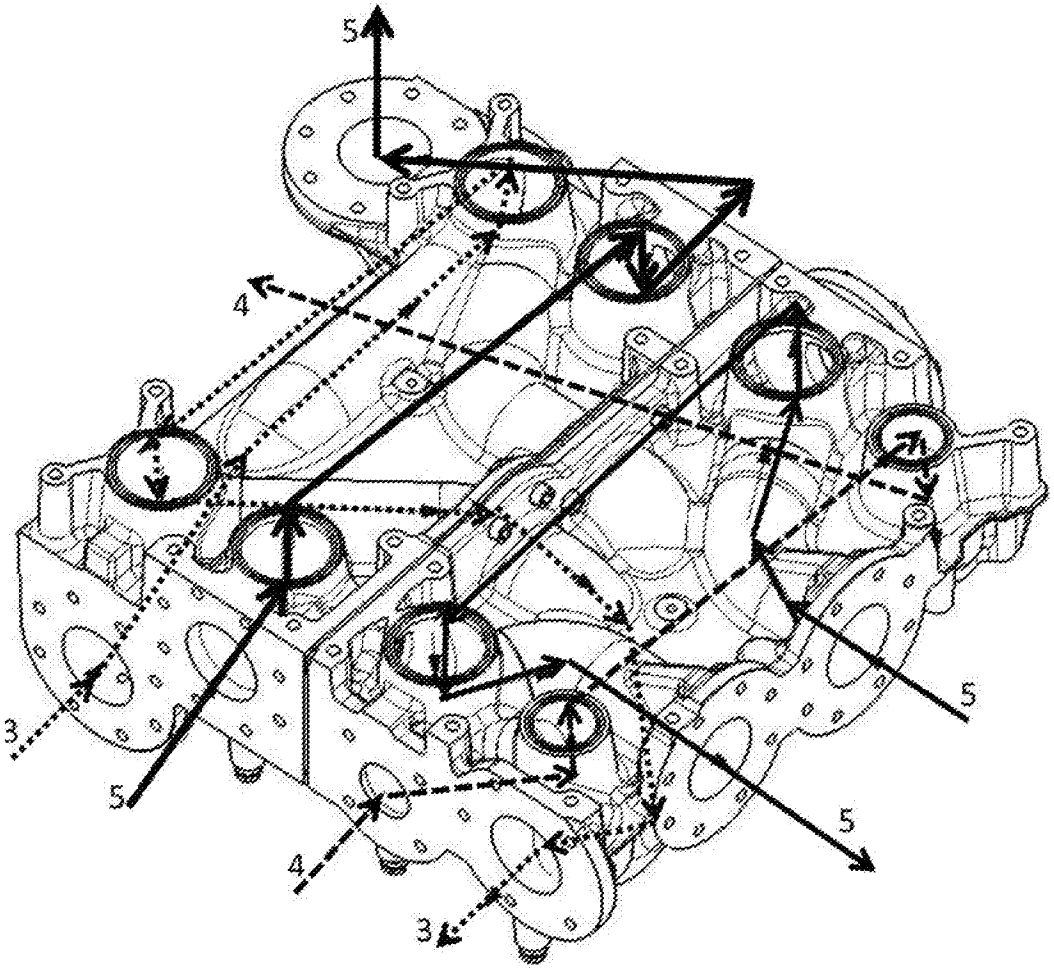

FIG. 3A to 3C show how different groups of channel sections 7 can be built for changing the order of the flow through and/or the combination of a heat exchange between the at least one engine temperature management circuit 3, the at least one lubrication temperature management circuit 4 and the at least one further medium circuit 5 by blocking individual connection openings 8 of the temperature management medium distributor 1 (wherein the temperature management medium distributor 1 corresponds to the temperature management medium distributor 1 of FIG. 1) and/or connecting individual connection openings 8 of the temperature management medium distributor 1. It should be noted that the at least one engine temperature management circuit 3 and the at least one lubrication temperature management circuit 4 have the same flow path in each configuration of the FIG. 3A to 3C.

The at least one lubrication temperature management circuit 4 is indicated in FIG. 3A to 3C by a dashed arrow, the at least one engine temperature management circuit 3 by a dotted arrow and the at least one further temperature management medium circuit 5 by an arrow with a solid line.

This means that in each configuration of the FIG. 3A to 3C the at least one engine temperature management circuit 3 and the at least one lubrication temperature management circuit 4 enter the temperature management medium distributor 1 at the same connection openings 8, are forwarded to the heat exchangers 6 at the same connection openings 8, are led back from the heat exchangers 6 to the temperature management medium distributor 1 at the same connection openings 8 and finally leave the temperature management medium distributor 1 at the same connection openings 8.

The heat exchangers 6 are not illustrated in these figures for reasons of clarity. Also the heat exchangers 6 are mounted at the same connection openings 8. This significantly simplifies the piping between the internal combustion engine 2 and the temperature management medium distributor 1, reduces the sources of errors and reduces costs. The FIG. 3A to 3C are differing by the flow path of the at least one further medium circuit 5. The flow path of the at least one further medium circuit 5 can in that way simply be chosen according to the requirements before commissioning by the operator.

FIG. 3A shows a configuration, wherein the at least one further medium circuit 5 firstly experiences a heat exchange with the at least one lubrication temperature management circuit 4 in the heat exchanger 6 and afterward a heat exchange with the at least one engine temperature management circuit 3 in the heat exchanger 6. Thereby the at least one lubrication temperature management circuit 4 can be tempered more effectively than the at least one engine temperature management circuit 3. As already mentioned for reasons of clarity the heat exchangers 6 are not shown in the FIG. 3A to 3C.

In the configuration as shown in FIG. 3B the at least one further medium circuit 5 firstly experiences a heat exchange with the at least one engine temperature management circuit 3 in the heat exchanger 6 and afterwards a heat exchange with the at least one lubrication temperature management circuit 4 in the heat exchanger 6. In this example the at least one engine temperature management circuit 3 can be tempered more effectively than the at least one lubrication temperature management circuit 4.

The configuration illustrated in FIG. 3C shows that at least two further temperature management medium circuits 5 are provided. In this way the at least one lubrication temperature management circuit 4 and the at least one engine temperature management circuit 3 can be tempered independently of each other. The two further temperature management medium circuits 5 are represented with arrows of different line thickness.

What we claim is:

1. A temperature management medium distributor for an internal combustion engine comprising:

first connection openings for at least one engine temperature management circuit for temperature management of the internal combustion engine;

at least one lubrication temperature management circuit for temperature management of a lubricant of the internal combustion engine;

at least one further medium circuit for removing from or supplying thermal energy to the internal combustion engine;

second connection openings for heat exchangers, with the heat exchangers heat can be exchanged in a pairwise manner between each of the at least one engine temperature management circuit, the at least one lubrication temperature management circuit, and the at least one further medium circuit; and channel sections to produce fluid connections between the first connection openings and the second connection openings;

wherein a first group of the channel sections is provided for the at least one further medium circuit, which, if the heat exchangers are connected, leads a flow of the at least one further medium circuit at first to a heat exchange with the at least one engine temperature management circuit and then to a heat exchange with the at least one lubrication temperature management circuit, and a second group of the channel sections is provided for the at least one further medium circuit, which, if the heat exchangers are connected, leads the flow of the at least one further medium circuit at first to a heat exchange with the at least one lubrication temperature management circuit and then to a heat exchange with the at least one engine temperature management circuit.

2. A temperature management medium distributor for an internal combustion engine comprising:

first connection openings for at least one engine temperature management circuit for temperature management of the internal combustion engine;

at least one lubrication temperature management circuit for temperature management of a lubricant of the internal combustion engine;

at least two further medium circuits for removing from or supplying thermal energy to the internal combustion engine;

second connection openings for heat exchangers, with the heat exchangers heat can be exchanged in a pairwise manner between each of the at least one engine temperature management circuit, the at least one lubrication temperature management circuit, and the at least two further medium circuits; and channel sections to produce fluid connections between the first connection openings and the second connection openings;

wherein a first group of the channel sections is provided for at least one of the at least two further medium circuits, which, if the heat exchangers are connected, leads a flow of at least one of the at least two further medium circuits at first to a heat exchange with the at least one engine temperature management circuit and then to a heat exchange with the at least one lubrication temperature management circuit, a second group of the channel sections is provided for at least one of the at least two further medium circuits, which, if the heat exchangers are connected, leads the flow of at least one of the at least two further medium circuits at first to a heat exchange with the at least one lubrication temperature management circuit and then to a heat exchange with the at least one engine temperature management circuit, and a third group and a fourth group of the channel sections are provided for at least one first and at least one second of the at least two further medium circuits, which, if the heat exchangers are connected, leads the flows of the at least one first and at least one second of the at least two further medium circuits in parallel to the heat exchanges with the at least one engine temperature management circuit and the at least one lubrication temperature management circuit.

3. The temperature management medium distributor for the internal combustion engine as set forth in claim 1 or 2, wherein the first and the second group of channel sections have common channel sections.

4. The temperature management medium distributor for the internal combustion engine as set forth in claim 2, wherein at least two of the first, the second, the third and the fourth group of channel sections have common channel sections.

5. The temperature management medium distributor for the internal combustion engine as set forth in claim 1 or 2, wherein the temperature management medium distributor is formed in one piece or formed out of a set of components.

6. The temperature management medium distributor for the internal combustion engine as set forth in claim 1 or 2, wherein the channel sections are configured as cavities.

7. The temperature management medium distributor for the internal combustion engine as set forth in claim 1 or 2, wherein the temperature management medium distributor comprises a first manifold and a second manifold each comprising a plurality of channel sections, wherein the channel sections of the first manifold and the channel sections of the second manifold can be connected to form a fluid connection through an interface.

8. The temperature management medium distributor for the internal combustion engine as set forth in claim 7, wherein a baffle plate can be inserted at the interface, by which baffle plate at least one of the fluid connections between the channel sections of the first manifold and the second manifold can be blocked or at least partially be connected.

9. The temperature management medium distributor for the internal combustion engine as set forth in claim 1 or 2, wherein the flow through the channel sections can be defined by plugs attached to individual connection openings and/or attached at channel sections between individual connection openings.

10. The temperature management medium distributor for the internal combustion engine as set forth in claim 1 or 2, wherein the temperature management medium distributor is designed by at least two separate parts.

11. The temperature management medium distributor for the internal combustion engine as set forth in claim 10, wherein the at least two separate parts have at least one flange side, which comprises flange openings to the channel sections, wherein the at least two separate parts can be connected with each other at the at least one flange side.

12. The temperature management medium distributor for the internal combustion engine as set forth in claim 11, wherein the channel sections at least partially merge into one another at the flange side.

13. The temperature management medium distributor for the internal combustion engine as set forth in claim 10, wherein a baffle plate is provided between the at least two separate parts-by which one or more flange openings of the channel sections can be blocked or at least partially be connected.

14. An internal combustion engine comprising: a temperature management medium distributor as set forth in claim 1 or 2, wherein the first connection openings are connected with at least one engine temperature management circuit, with at least one lubrication temperature management circuit and with at least one further medium circuit and wherein the second connection openings are connected to heat exchangers.

15. A method for manufacturing an internal combustion engine comprising:

providing at least one engine temperature management circuit for temperature management of the internal combustion engine;

providing at least one lubrication temperature management circuit for temperature management of a lubricant of the internal combustion engine;

providing at least one further medium circuit for removing from or supplying thermal energy to the internal combustion engine;

providing one or more heat exchangers for exchanging heat between each of the at least one engine temperature management circuit, the at least one lubrication temperature management circuit, and the at least one further medium circuit; and assembling a temperature management medium distributor with the at least one engine temperature management circuit, the at least one lubrication temperature management circuit, and the at least one further medium circuit and/or the one or more heat exchangers in one configuration of a plurality of different assembly configurations, wherein each of the plurality of different assembly configurations defines a different flow path of the at least one further medium circuit relative to the at least one engine temperature management circuit and the at least one lubrication temperature management circuit.

16. The method as set forth in claim 15, wherein the one configuration can be changed between the plurality of different assembly configurations by at least one of the following steps:

blocking or connecting channel sections in one or more manifolds of the temperature management medium distributor via one or more plugs and/or one or more baffle plates;

assembling differently the temperature management medium distributor, if the temperature management medium distributor is built by a set of components; and connecting differently the temperature management medium distributor to the at least one engine temperature management circuit, the at least one lubrication temperature management circuit, and the at least one further medium circuit and/or the one or more heat exchangers by changing inlet and outlet connections at the one or more manifolds.

17. A method of using a temperature management medium distributor as set forth in claim 1 or 2.

18. The method as set forth in claim 15, wherein the plurality of different assembly configurations define different flow directions through the at least one further medium circuit and/or different sequences of heat exchange via the one or more heat exchangers relative to the at least one engine temperature management circuit and the at least one lubrication temperature management circuit.

19. The method as set forth in claim 15, wherein the plurality of different assembly configurations comprises at least two of:

a first assembly configuration defining a first flow path through the at least one further medium circuit to facilitate heat exchange in series with the at least one engine temperature management circuit followed by the at least one lubrication temperature management circuit;

a second assembly configuration defining a second flow path through the at least one further medium circuit to facilitate heat exchange in series with the at least one lubrication temperature management circuit followed by the at least one engine temperature management circuit; or a third assembly configuration defining third and fourth flow paths through the at least one further medium circuit to facilitate heat exchange in parallel with the at least one lubrication temperature management circuit and the at least one engine temperature management circuit.

20. The method as set forth in claim 15, wherein the temperature management medium distributor comprises:

a manifold assembly comprising first and second manifolds, wherein the manifold assembly comprises a plurality of channels and a plurality of openings;

a baffle plate configured to mount at an interface between the first and second manifolds between the plurality of channels; and one or more plugs configured to selectively mount in one or more of the plurality of openings;

wherein the plurality of different assembly configurations comprise one or more of: changes in the baffle plate to alter fluid connections between the plurality of channels, changes in plug locations of the one or more plugs in the one or more openings, and changes in inlet and outlet locations in the one or more openings.

* * * * *